US010559865B2

(12) United States Patent
Miyamoto

(10) Patent No.: US 10,559,865 B2
(45) Date of Patent: Feb. 11, 2020

(54) BAND PASS FILTER COMPRISING SETS OF FIRST AND SECOND DIELECTRIC RESONATORS DISPOSED WITHIN A HOUSING, WHERE THE FIRST AND SECOND DIELECTRIC RESONATORS HAVE AN ADJUSTABLE INTERVAL THERE BETWEEN

(71) Applicant: NEC CORPORATION, Tokyo (JP)

(72) Inventor: Takahiro Miyamoto, Tokyo (JP)

(73) Assignee: NEC CORPORATION, Minato-ku, Tokyo (JP)

( * ) Notice: Subject to any disclaimer, the term of this patent is extended or adjusted under 35 U.S.C. 154(b) by 70 days.

(21) Appl. No.: 15/742,187

(22) PCT Filed: Jun. 9, 2016

(86) PCT No.: PCT/JP2016/002795
§ 371 (c)(1),
(2) Date: Jan. 5, 2018

(87) PCT Pub. No.: WO2017/006516
PCT Pub. Date: Jan. 12, 2017

(65) Prior Publication Data

US 2018/0198182 A1 Jul. 12, 2018

(30) Foreign Application Priority Data

Jul. 7, 2015 (JP) ..... 2015-135819

(51) Int. Cl.
*H01P 1/20* (2006.01)
*H01P 7/10* (2006.01)
(Continued)

(52) U.S. Cl.
CPC ..... *H01P 1/2084* (2013.01); *H01P 1/2086* (2013.01); *H01P 1/2138* (2013.01); *H01P 7/10* (2013.01); *H01P 7/105* (2013.01)

(58) Field of Classification Search
CPC ..... H01P 1/2084; H01P 7/10
(Continued)

(56) References Cited

U.S. PATENT DOCUMENTS 3,693,115 A 9/1972 Edson
4,459,570 A 7/1984 Delaballe et al.
(Continued)

FOREIGN PATENT DOCUMENTS

JP 57-76901 A 5/1982
JP 09-055606 A 2/1997
(Continued)

OTHER PUBLICATIONS

International Search Report for PCT/JP2016/002795, dated Aug. 16, 2016.

*Primary Examiner* — Benny T Lee
(74) *Attorney, Agent, or Firm* — Sughrue Mion, PLLC

(57) ABSTRACT

A band pass filter suitable for varying the center frequency of the passband and a method for controlling the band pass filter are provided. A band pass filter of the present invention includes: two TE01δ-mode dielectric resonators (10) and (20) disposed so as to oppose to each other; and a housing (30) made of metal enclosing the two dielectric resonators (10) and (20). An opposing interval between two dielectric resonators (10) and (20) is variable.

10 Claims, 7 Drawing Sheets

(51) Int. Cl.
*H01P 1/208* (2006.01)
*H01P 1/213* (2006.01)

(58) Field of Classification Search
USPC ..... 333/202, 219.1
See application file for complete search history.

(56) References Cited

U.S. PATENT DOCUMENTS

| | | | | |
|---|---|---|---|---|
| 6,147,577 | A | 11/2000 | Cavey | |
| 7,352,263 | B2 * | 4/2008 | Pance et al. | H01P 1/2084 333/202 |
| 2007/0115080 | A1 * | 5/2007 | Pance et al. | H01P 1/2084 333/202 |

FOREIGN PATENT DOCUMENTS

| | | | |
|---|---|---|---|
| JP | 2001-156546 | A | 6/2001 |
| JP | 2002-050902 | A | 2/2002 |
| JP | 2004-129146 | A | 4/2004 |
| WO | 2005/062415 | A1 | 7/2005 |

* cited by examiner

BAND PASS FILTER COMPRISING SETS OF FIRST AND SECOND DIELECTRIC RESONATORS DISPOSED WITHIN A HOUSING, WHERE THE FIRST AND SECOND DIELECTRIC RESONATORS HAVE AN ADJUSTABLE INTERVAL THERE BETWEEN

CROSS REFERENCE TO RELATED APPLICATIONS

This application is a National Stage of International Application No. PCT/JP2016/002795 filed Jun. 9, 2016, claiming priority based on Japanese Patent Application No. 2015-135819 filed Jul. 7, 2015, the contents of all of which are incorporated herein by reference in their entirety.

TECHNICAL FIELD

The present invention relates to a band pass filter (BPF) and a method for controlling the same.

BACKGROUND ART

A communication device performing microwave communication or millimeter wave communication includes a band pass filter that passes only high-frequency signals of a desired frequency band and attenuates signals of unwanted frequency bands. In recent years, in designing a communication system, there has been an increasing demand for a band pass filter included in the communication device whose center frequency of a passband is externally variable.

Related art such as Patent Literatures 1 to 3 each disclose the technique of structuring a band pass filter using a TE01δ-mode dielectric resonator (DR), and externally adjusting the resonance frequency of the dielectric resonator. Specifically, according to the technique disclosed in Patent Literatures 1 and 2, a conductive plate is disposed between a dielectric resonator and a housing covering the dielectric resonator. The resonance frequency is adjusted by varying the interval between the conductive plate and the dielectric resonator. Further, according to the technique disclosed in Patent Literature 3, an adjustment screw is inserted into an adjustment hole provided at the upper surface of a housing covering the dielectric resonator, in which the adjustment hole is positioned above the dielectric resonator. The resonance frequency is adjusted by varying the insertion amount of the adjustment screw.

CITATION LIST

Patent Literature

Patent Literature 1: Japanese Unexamined Patent Application Publication No. 2002-050902

Patent Literature 2: Japanese Unexamined Patent Application Publication No. 2004-129146

Patent Literature 3: International Patent Publication No. WO2005/062415

SUMMARY OF THE INVENTION

Technical Problem

As described above, the technique disclosed in Patent Literatures 1 and 2 relates to adjusting the resonance frequency by varying the interval between the TE01δ-mode dielectric resonator and the conductive plate. On the other hand, the resonance frequency of the dielectric resonator largely depends on the shape and permittivity of the dielectric resonator. Accordingly, varying the interval between the dielectric resonator and the conductive plate as in the technique disclosed in Patent Literatures 1 and 2 cannot largely vary the resonance frequency of the dielectric resonator. Therefore, the technique disclosed in Patent Literatures 1 and 2 is merely applicable to error adjustment, such as adjusting errors in shape of the dielectric resonator or the housing, or in mounting the dialectic resonators, as disclosed in Patent Literatures 1 and 2. To meet the above-described demand for a band pass filter whose center frequency of the passband is variable, a wider adjustment range is required of the center frequency and, consequently, the technique disclosed in Patent Literatures 1 and 2 is not applicable.

Further, similar to the technique disclosed in Patent Literatures 1 and 2, the technique disclosed in Patent Literature 3 also addresses the adjusting the resonance frequency by varying the interval between the dielectric resonator and the adjustment screw. Therefore, the technique disclosed in Patent Literature 3 is also merely applicable to error adjustment, and not applicable to realizing the variable center frequency of the passband of a band pass filter.

An object of the present invention is to solve the above-described problem, and to provide a band pass filter suitable for varying the center frequency of the passband and a method for controlling the band pass filter.

Solution to the Problem

In one example aspect, a band pass filter comprising:

first and second TE01δ-mode dielectric resonators disposed so as to oppose to each other; and a housing made of metal enclosing the first and second dielectric resonators, wherein an opposing interval between the first and second dielectric resonators is variable.

In one example aspect, a method for controlling a band pass filter, comprising:

providing TE01δ-mode first and second dielectric resonators disposed so as to oppose to each other, and a housing made of metal enclosing the first and second dielectric resonators; and varying an opposing interval between the first and second dielectric resonators.

Advantageous Effects of the Invention

The above-described aspect exhibits the effect of providing a band pass filter suitable for varying the center frequency of the passband and a method for controlling the band pass filter.

DETAILED DESCRIPTION OF EXEMPLARY EMBODIMENTS

In the following, with reference to the drawings, a description will be given of exemplary embodiments of the present invention.

(1) First Exemplary Embodiment

Figure 1:
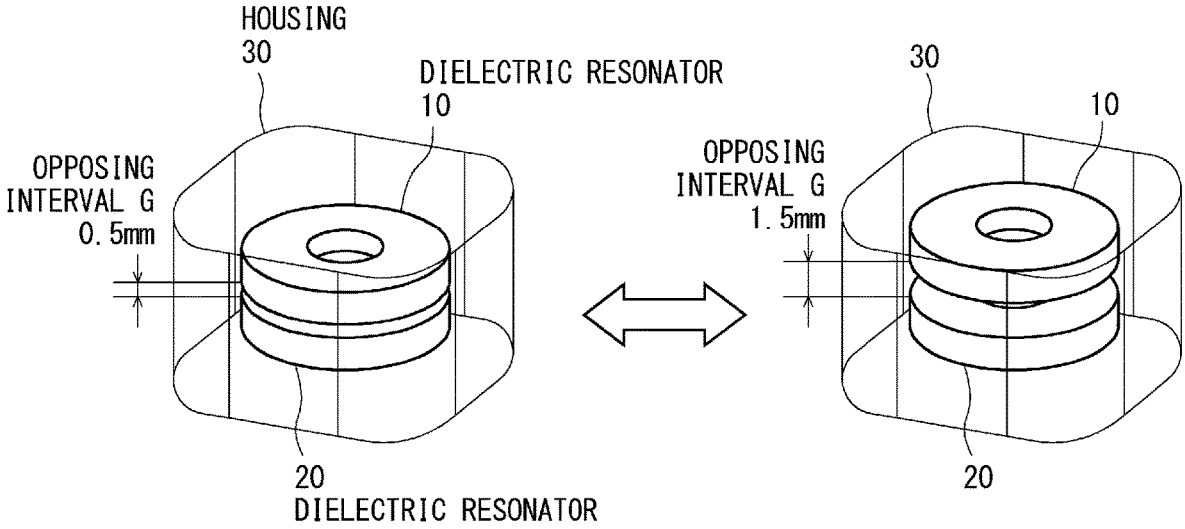
FIG. 1 is a perspective view showing the schematic exemplary structure of a band pass filter according to the first exemplary embodiment of the present invention.

FIG. 1 is a perspective view showing the schematic exemplary structure of a band pass filter according to the present exemplary embodiment. Note that, FIG. 1 shows a housing in a transparent manner (the same holds true for FIGS. 2 to 4, FIGS. 6 to 9, which will be referred to later). As shown in FIG. 1, the band pass filter according to the present exemplary embodiment includes two dielectric resonators 10, 20 resonating one TE01δ mode, which are arranged one on the other opposing to each other. Further, the two dielectric resonators 10, 20 are enclosed in a housing 30 made of metal. The dielectric resonators 10, 20 have a shape obtained by dividing a hollow circular cylinder into equal two parts along a section substantially parallel to the bottom surface (that is, each of the parts has the same hollow circular cylindrical shape), and disposed so as to have their respective surfaces resultant from the dividing opposed to each other, which resultant surfaces are hereinafter referred to as the opposing surfaces. Further, the dielectric resonators 10, 20 are made of an identical dielectric material. Note that, one of the dielectric resonators 10, 20 is referred to as the first dielectric resonator, while the other one is referred to as the second dielectric resonator.

An opposing interval G between the dielectric resonators 10, 20 is variable. On the left side in FIG. 1, an exemplary structure in which the opposing interval G is 0.5 mm is shown. On the right side in FIG. 1, an exemplary structure in which the opposing interval G is 1.5 mm is shown. Any mechanism may be employed as an interval adjusting mechanism that varies the opposing interval G. For example, an interval adjusting mechanism may fix the position of the lower dielectric resonator 20 in the direction in which the dielectric resonators 10, 20 oppose to each other (the first direction; in the present exemplary embodiment, the top-bottom direction; hereinafter referred to as the top-bottom direction) with a fixing member, and shift the upper dielectric resonator 10 in the top-bottom direction with a shifting mechanism. The fixing member may be structured by, for example, a mount disposed on the inner side of the lower surface of the housing 30. On the mount, the dielectric resonator 20 may be placed and fixed thereto so as to have its back surface relative to the opposing surface been in contact with the mount. Further, the shifting mechanism may be structured by, for example, a supporting rod inserted into the housing 30 from above, to which supporting rod the dielectric resonator 10 is fixed so as to have its back surface relative to the opposing surface been in contact with the supporting rod, and a drive unit being a motor or the like that shifts the supporting rod in the top-bottom direction. In this structure, the opposing interval G is varied by fixing the dielectric resonator 20 to the mount and shifting the supporting rod inserted from above the housing 30 in the top-bottom direction by the drive unit.

Figure 2:
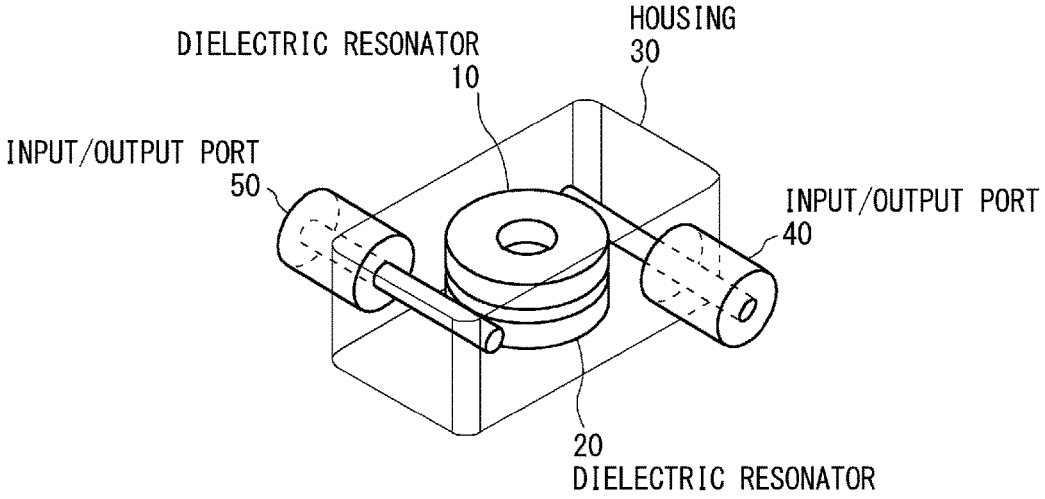
FIG. 2 is a perspective view showing the exemplary structure of the band pass filter according to the first exemplary embodiment of the present invention.
Figure 3:
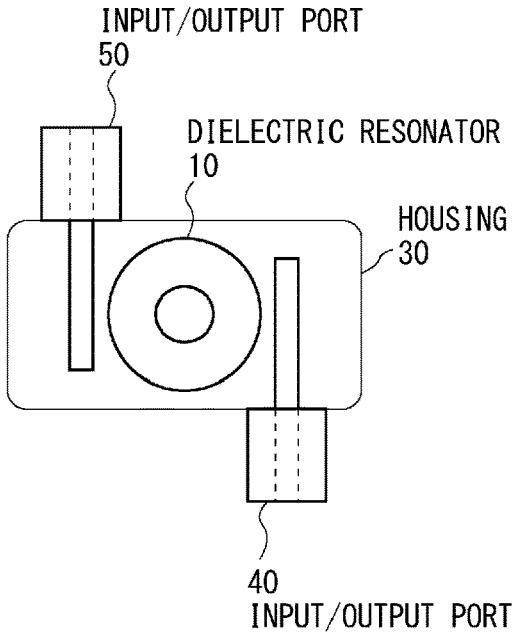
FIG. 3 is a plan view showing the exemplary structure of the band pass filter according to the first exemplary embodiment of the present invention.
Figure 4:
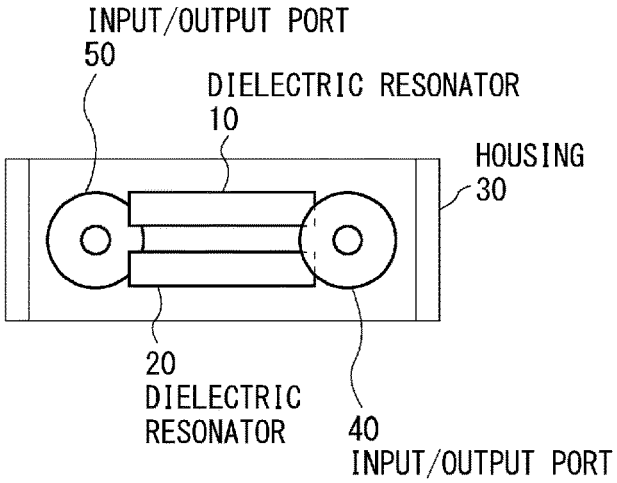
FIG. 4 is a front view showing the exemplary structure of the band pass filter according to the first exemplary embodiment of the present invention.

FIGS. 2 to 4 are diagrams showing the exemplary structure of the band pass filter according to the present exemplary embodiment in more detail. FIG. 2 is a perspective view, FIG. 3 is a plan view, and FIG. 4 is a front view. As shown in FIGS. 2 to 4, into both lateral surfaces of the housing 30 opposing to each other, input/output ports 40, 50 each structured by a coaxial line, are respectively externally inserted. Respective inner conductors of the coaxial lines extend inside the housing 30, so that the dielectric resonators 10, 20 (FIGS. 2 and 4) are positioned sideways between them. The input/output ports 40, 50 are ports for inputting and outputting high-frequency signals. The inner conductors extending inside the housing 30 serve as antennas and are connected to the dielectric resonators 10, 20 by electromagnetic coupling. For example, when high-frequency signals are input into the input/output port 40, only the high-frequency signals in a frequency band that coincide with the resonance frequency of the dielectric resonators 10, 20 as a whole are output from the input/output port 50.

In the present exemplary embodiment, the opposing interval G (FIG. 1) between the two TE01δ-mode dielectric resonators 10, 20 is variable. Here, when the opposing interval G varies, the dielectric resonators 10, 20 as a whole expand or contract in the top-bottom direction. As a result, the shape of the dielectric resonators 10, 20 as a whole varies and, consequently, the resonance frequency of the dielectric resonators 10, 20 as a whole varies. Using this phenomenon, the present exemplary embodiment varies the opposing interval G thereby varying the shape of the dielectric resonators 10, 20 as a whole, and thereby varying the resonance frequency of the dielectric resonators 10, 20 as a whole.

Figure 5:
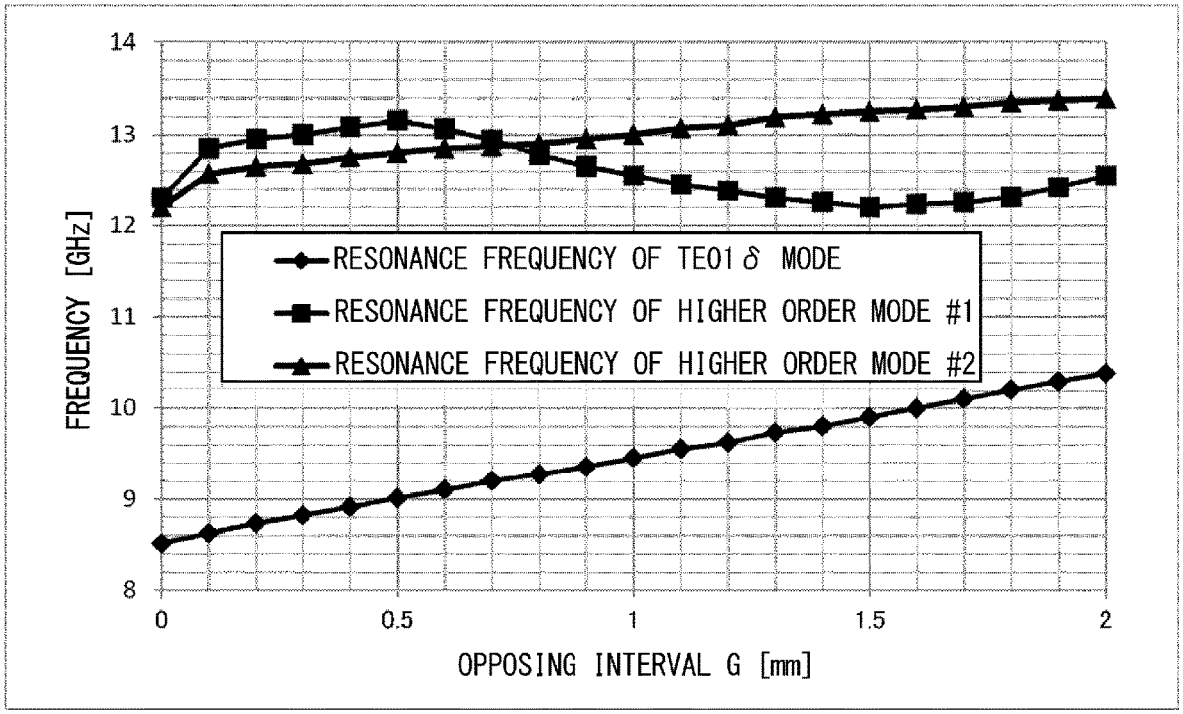
FIG. 5 is a diagram showing an exemplary resonance frequency of a dielectric resonator structuring the band pass filter according to the first exemplary embodiment of the present invention.

FIG. 5 is a graph showing an exemplary resonance frequency (in GHz) of the dielectric resonators 10, 20 as a whole when the opposing interval G [mm] in between the dielectric resonators 10, 20 is varied. Since the present exemplary embodiment is a single-stage band pass filter, the resonance frequency of the TE01δ mode shown in FIG. 5 corresponds to the center frequency of the passband of the band pass filter. Here, it is assumed that the dielectric resonators 10, 20 are each a hollow circular cylinder having an outer radius of 4 mm, an inner radius (the radius of the hollow part) of 1.5 mm, and a height of 1.5 mm, and which is made of a dielectric material having a permittivity of 29.8. As shown in FIG. 5, the resonance frequency of TE01δ mode becomes higher as the opposing interval G [mm] becomes greater. It can be seen that, as the opposing interval G [mm] is varied from 0 mm to 2.0 mm, the resonance frequency of TE01δ mode largely varies from about 8.5 GHz to 10.3 GHz. Further, in this case, while the resonance frequency of TE01δ mode varies, unwanted resonance frequencies of higher order modes #1, #2 for the band pass filter vary little. Hence, since the necessity of taking into account of any influence of the higher order modes #1, #2 in designing the band pass filter, the present embodiment contributes to easier designing.

As described above, in the present exemplary embodiment, the opposing interval G [mm] between the two TE01δ-mode dielectric resonators 10, 20 is variable. Here, when the opposing interval G [mm] is varied, the shape of the dielectric resonators 10, 20 as a whole varies. Accordingly, by varying the opposing interval G [mm], the shape of the dielectric resonators 10, 20 as a whole varies and, consequently, a large variation of the resonance frequency is achieved. This configuration implements a band pass filter suitable for varying the center frequency of the passband. Further, by virtue of dispensing with any additional component with low Q factor in the mechanism for varying the opposing interval G [mm], the inherent high Q factor of the TE01δ-mode dielectric resonators 10, 20 is exhibited. Hence, this configuration also implements a band pass filter with a minimum degradation in Q factor. Further, with the band pass filter according to the present exemplary embodiment, Q factor little changes also in the case where the opposing interval G [mm] is varied from 0 mm to 2.0 mm.

(2) Second Exemplary Embodiment

Figure 6:
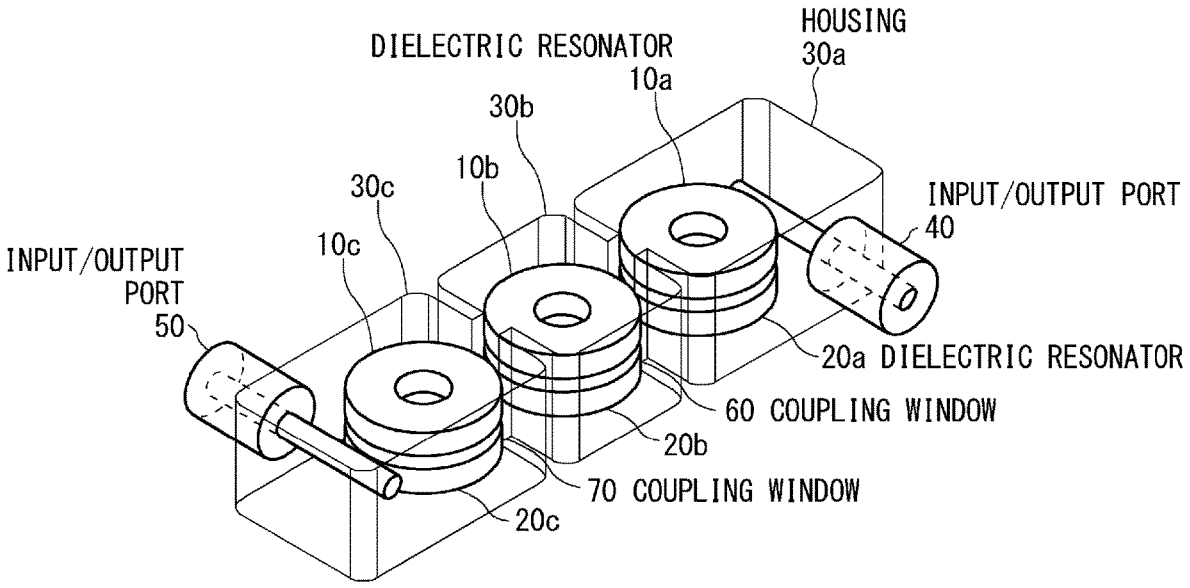
FIG. 6 is a perspective view showing the exemplary structure of the band pass filter according to the second exemplary embodiment of the present invention.
Figure 7:
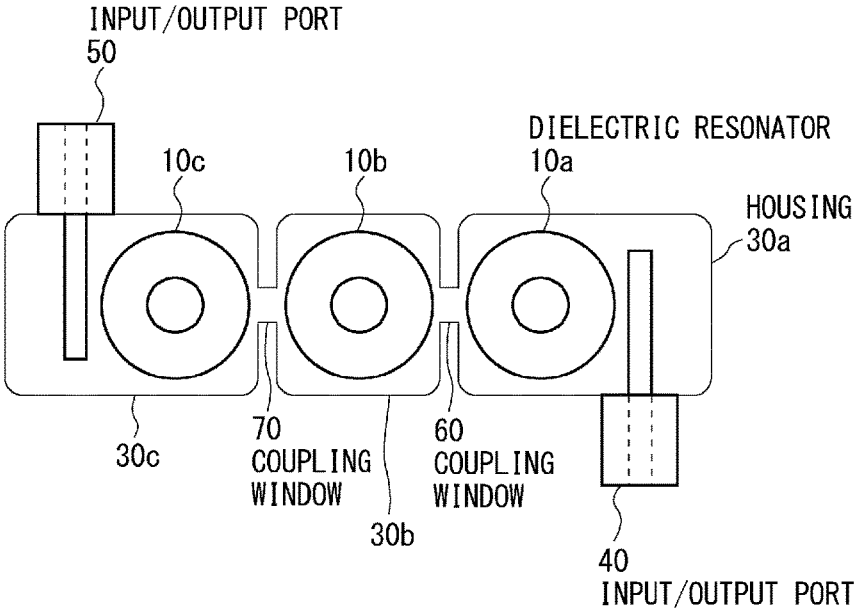
FIG. 7 is a plan view showing the exemplary structure of the band pass filter according to the second exemplary embodiment of the present invention.
Figure 8:
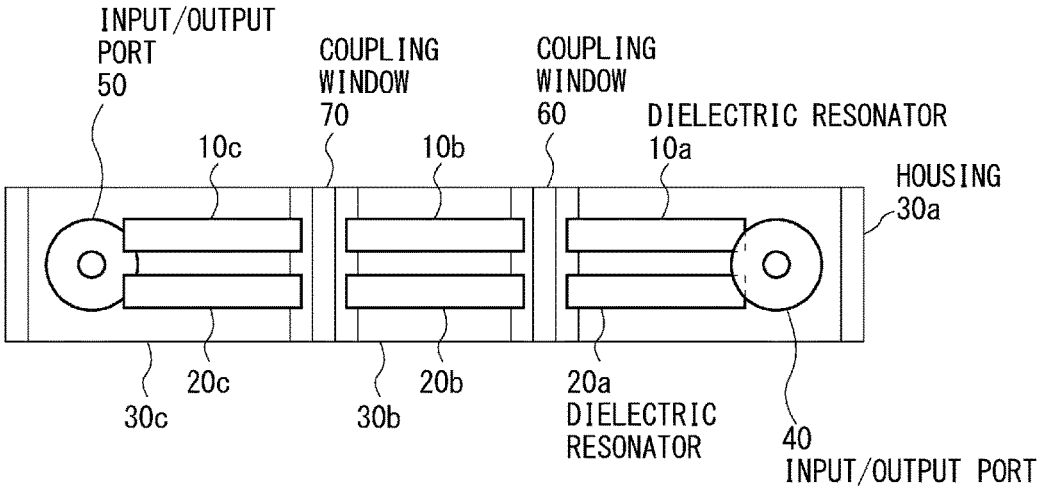
FIG. 8 is a front view showing the exemplary structure of the band pass filter according to the second exemplary embodiment of the present invention.

The first exemplary embodiment is structured as a single-stage band pass filter including a set of two dielectric resonators. On the other hand, the present exemplary embodiment is structured as a three-stage band pass filter including three sets of two dielectric resonators. FIGS. 6 to 8 show the exemplary structure of the band pass filter according to the present exemplary embodiment. FIG. 6 is a perspective view, FIG. 7 is a plan view, FIG. 8 is a front view. As shown in FIGS. 6 to 8, the band pass filter according to the present exemplary embodiment corresponds to a structure in which three sets of two dielectric resonators 10*a*, 20*a*, 10*b*, 20*b*, 10*c* and 20*c* according to the first exemplary embodiment are provided in the arrangement direction (the second direction; in the present exemplary embodiment, the horizontal direction) which is substantially perpendicular to the direction in which the dielectric resonators 10, 20 oppose to each other (the first direction; in the present exemplary embodiment, the top-bottom direction; hereinafter referred to as the top-bottom direction). That is, the band pass filter according to the present exemplary embodiment includes a set of two dielectric resonators 10*a*, 20*a*, a set of two dielectric resonators 10*b*, 20*b*, and a set of two dielectric resonators 10*c*, 20*c* arranged in the arrangement direction substantially perpendicular to the top-bottom direction. Note that, in the following, when the dielectric resonators 10*a*, 10*b*, 10*c* are not specified, they are referred to as the dielectric resonator 10 as appropriate, and when the dielectric resonators 20*a*, 20*b*, 20*c* (FIGS. 6 and 8) are not specified, they are referred to as the dielectric resonator 20 as appropriate.

Further, in the band pass filter according to the present exemplary embodiment, the dielectric resonators 10*a*, 20*a* are enclosed by a housing 30*a* made of metal, the dielectric resonators 10*b*, 20*b* are enclosed by a housing 30*b* made of metal, and the dielectric resonators 10*c*, 20*c* are enclosed by a housing 30*c* made of metal. Further, between adjacent housings 30*a*, 30*b*, a coupling window 60 (FIGS. 9 and 10) for coupling the space inside the housings 30*a*, 30*b* is provided. Between adjacent housings 30*b*, 30*c*, a coupling window 70 (FIGS. 9, 10 and 12) for coupling the space inside the housings 30*b*, 30*c* is provided.

Note that, the input/output ports 40, 50 (FIG. 9) are structured similarly to the first exemplary embodiment except that the input/output ports 40, 50 are respectively inserted into the housings 30*a*, 30*c* at the both ends in the arrangement direction and, therefore, the description thereof is omitted.

Figure 9:
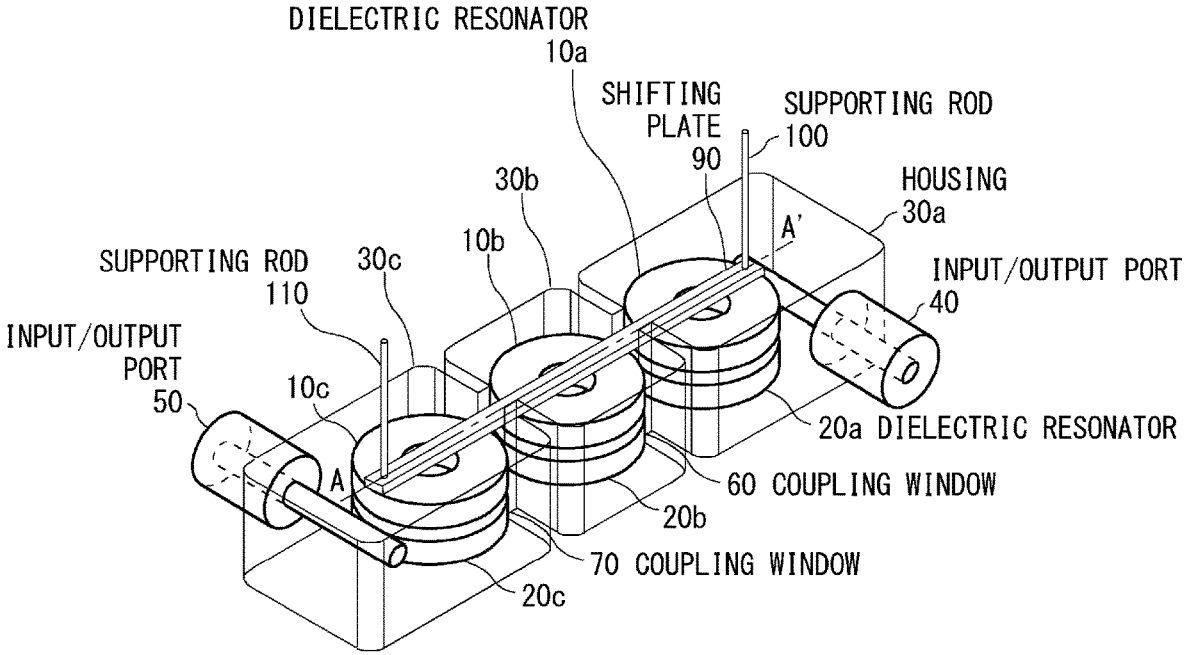
FIG. 9 is a perspective view showing the exemplary structure of the interval adjusting mechanism used in the band pass filter according to the second exemplary embodiment of the present invention.
Figure 10:
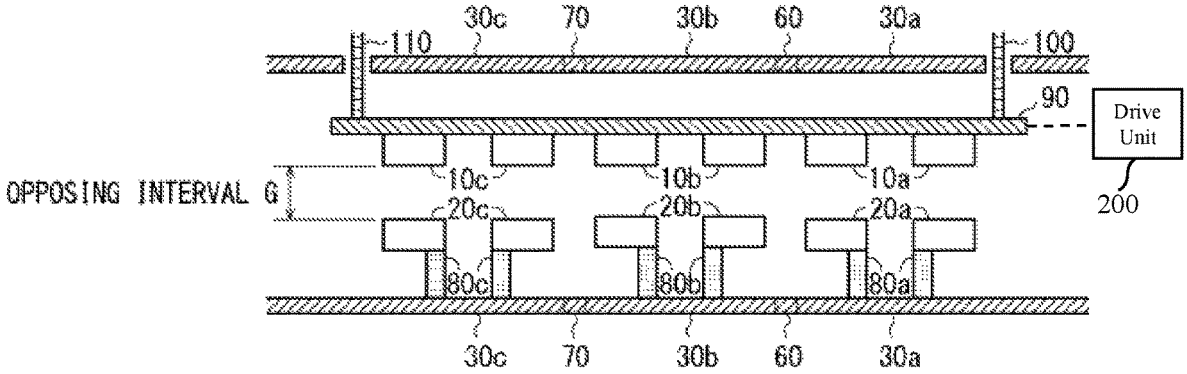
FIG. 10 is a section view showing the exemplary structure of the interval adjusting mechanism used in the band pass filter according to the second exemplary embodiment of the present invention.

In the present exemplary embodiment also, similarly to the first exemplary embodiment, the opposing interval G (not shown) between the dielectric resonators 10*a*, 20*a*, the opposing interval G (not shown) between the dielectric resonators 10*b*, 20*b*, and the opposing interval G knot shown) between the dielectric resonators 10*c*, 20*c* are variable. Here, a description is given of the interval adjusting mechanism that varies the opposing interval G. FIGS. 9 and 10 show the exemplary structure of the interval adjusting mechanism used in the band pass filter according to the present exemplary embodiment. FIG. 9 is a perspective view, and FIG. 10 is a section view taken along line A-A' in FIG. 9. As shown in FIG. 9, into the both lateral surfaces of the housing 30 opposing to each other, input/output ports 40, 50 each structured by a coaxial line are respectively externally inserted. As shown in FIGS. 9 and 10, in the band pass filter according to the present exemplary embodiment, the interval adjusting mechanism is structured by a fixing member for fixing the position in the top-bottom direction of the lower dielectric resonators 20*a*, 20*b*, 20*c* in the sets, and a shifting mechanism for collectively shifting the upper dielectric resonators 10*a*, 10*b*, 10*c* in the sets in the top-bottom direction.

First, a description will be given of the fixing member. In the present exemplary embodiment, as the fixing member, mounts 80*a*, 80*b*, 80*c* are provided as shown in FIG. 10. The mounts 80*a*, 80*b*, 80*c* are respectively provided on the inner side of the lower surfaces of the housings 30*a*, 30*b*, 30*c*. On the mounts 80*a*, 80*b*, 80*c*, the lower dielectric resonators 20*a*, 20*b*, 20*c* are respectively placed and fixed thereto so as to have back surfaces thereof relative to opposing surfaces thereof being in contact with the mounts 80*a*, 80*b*, 80*c*. Note that, the mounts 80*a*, 80*b*, 80*c* are made of forsterite or the like. Note that, while the shape of the mounts 80*a*, 80*b*, 80*c* are hollow circular cylindrical, the present invention is not limited thereto.

Next, a description will be given of the shifting mechanism. In the present exemplary embodiment, as the shifting mechanism, a shifting plate 90, supporting rods 100, 110 and a drive unit 200 being a motor or the like are provided. The shifting plate 90 is disposed so as to extend in the arrangement direction in the inner space of the housings 30*a*, 30*b*, 30*c*. The upper dielectric resonators 10*a*, 10*b*, 10*c* in the sets are fixed to the shifting plate 90 so as to have back surfaces thereof relative to opposing surfaces thereof being in contact with the shifting plate 90. Further, the supporting rods 100, 110 are inserted from above the housings 30*a*, 30*c* through holes for passing the supporting rods, which holes are respectively formed at the upper surfaces of the housings 30*a*, 30*c*. The supporting rods 100, 110 support the shifting plate 90. Note that, the shifting plate 90 may be an alumina plate or the like, and the supporting rods 100, 110 may be made of zirconia or the like. Further, the drive unit 200 shifts the shifting plate 90 and the supporting rods 100, 110 in the top-bottom direction. So long as the drive unit 200 is capable of performing the above-described operation, the drive unit 200 may be implemented in any structure, and may be in a well-known structure. By the drive unit 200 performing the foregoing operation, the upper dielectric resonators 10*a*, 10*b*, 10*c* of the sets fixed to the shifting plate 90 are collectively shifted in the top-bottom direction. Therefore, the opposing interval G (FIG. 10) between the dielectric resonators 10*a*, 20*a*, the opposing interval G between the dielectric resonators 10*b*, 20*b*, and the opposing interval G between the dielectric resonators 10*c*, 20*c* are collectively varied.

Next, a description will be given of a method of varying the opposing interval G between the dielectric resonators 10*a*, 20*a*, the opposing interval G between the dielectric resonators 10*b*, 20*b*, and the opposing interval G between the dielectric resonators 10*c*, 20*c* using the interval adjusting mechanism. Here, it is assumed that the lower dielectric resonators 20*a*, 20*b*, 20*c* in the sets are respectively previously fixed to the mounts 80*a*, 80*b*, 80*c*, and the upper dielectric resonators 10*a*, 10*b*, 10*c* in the sets are previously fixed to the shifting plate 90.

Figure 11:
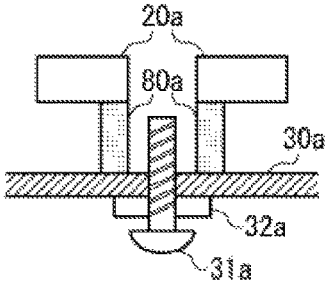
FIG. 11 is a section view showing the exemplary structure of the electromagnetic field distribution adjusting mechanism used in the band pass filter according to the second exemplary embodiment of the present invention.
Figure 12:
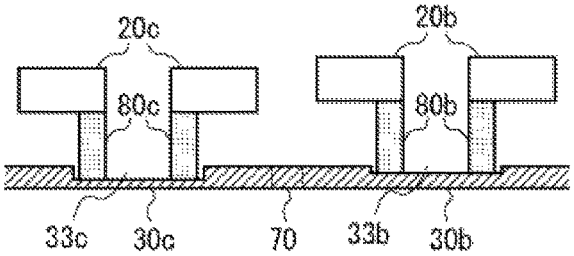
FIG. 12 is a section view showing the exemplary structure of the position adjusting mechanism used in the band pass filter according to the second exemplary embodiment of the present invention.

First, the disposition state of the lower dielectric resonators 20*a*, 20*b*, 20*c* in the sets is adjusted. It is known that Q factor is highest when a dielectric resonator is at the center (longitudinally, laterally, in height) inside a housing. Accordingly, in designing a plural-stage band pass filter, the coupling coefficient is calculated for each stage according to the design parameter such as a Chebyshev's distribution or the like, and the physical dimension for each stage is designed so as to coincide with the calculated coupling coefficient. The method and mechanism (the disposition adjusting mechanism) for adjusting the lower dielectric resonators 20*a*, 20*b*, 20*c* in the sets to the state where the lower dielectric resonators 20*a*, 20*b*, 20*c* are physically disposed in the physical dimension according to the design parameter may be any method and mechanism for adjusting the electromagnetic field distribution of the dielectric resonators 20*a*, 20*b*, 20*c* or their position in the top-bottom direction. The electromagnetic field distribution adjusting mechanism that adjusts the electromagnetic field distribution of the dielectric resonators 20*a*, 20*b*, 20*c* may be the mechanism shown in FIG. 11. The electromagnetic field distribution adjusting mechanism shown in FIG. 11 adjusts the electromagnetic field distribution of the dielectric resonator 20*a* by inserting or retracting an adjustment screw 31*a* externally at the lower surface of the housing 30*a*. Note that, the adjustment screw 31*a* may be made of a metal material or a dielectric material. Further, in FIG. 11, while the adjustment screw 31*a* is fixed by a nut 32*a* joined to the housing 30*a*, the adjustment screw 31*a* may be fixed with an adhesive agent. While not shown in the drawings, the electromagnetic field distribution of the dielectric resonators 20*b*, 20*c* can also be adjusted by the mechanism similar to that shown in FIG. 11. Further, the position adjusting mechanism that adjusts the position in the top-bottom direction of the dielectric resonators 20*a*, 20*b*, 20*c* may be a mechanism installing the mount 80*a* (FIG. 11) having a height corresponding to the adjustment target position, a mechanism in which an adjustment screw integrated with the lower surface of a mount is inserted or retracted externally at the lower surface of the housing, or the mechanism shown in FIG. 12. In the position adjusting mechanism shown in FIG. 12, on the inner side of respective lower surfaces of the housings 30*b*, 30*c*, bottomed spot faces 33*b*, 33*c* where the dielectric resonators 20*b*, 20*c* are respectively installed are formed. By the depth of the spot faces 33*b*, 33*c*, the position in the top-bottom direction of the dielectric resonators 20*b*, 20*c* is adjusted. Note that, in the mechanism shown in FIG. 12, the mounts 80*b*, 80*c* are identical to each other in height in the top-bottom direction. Further, FIG. 12 shows an exemplary structure in which, as a result of following the design parameter, the central dielectric resonator 20*b* becomes higher in position in the top-bottom direction than the dielectric resonator 20*a* (not shown) and the dielectric resonator 20*c* at the both ends. While not shown in the drawings, the position in the top-bottom direction of the dielectric resonator 20*a* can also be adjusted by the mechanism similar to the mechanism shown in FIG. 12. Note that, the design parameter used in designing the band pass filter is not used in the Chebyshev's distribution, and the Butterworth filter, the elliptic function or the like may be used. In designing the band pass filter, such a design parameter should be selected as appropriate for each design purpose.

In the foregoing manner, the lower dielectric resonators 20*a*, 20*b*, 20*c* in the sets are adjusted to the state where the lower dielectric resonators 20*a*, 20*b*, 20*c*, are physically disposed according to the design parameter. Subsequently, the drive unit shifts the shifting plate 90 and the supporting rods 100, 110 in the top-bottom direction, thereby collectively shifting the upper dielectric resonators 10*a*, 10*b*, 10*c* in the sets fixed to the shifting plate 90 in the top-bottom direction. Thus, the opposing interval G between the dielectric resonators 10*a*, 20*a*, the opposing interval G between the dielectric resonators 10*b*, 20*b*, and the opposing interval G between the dielectric resonators 10*c*, 20*c* are collectively varied.

Figure 13:
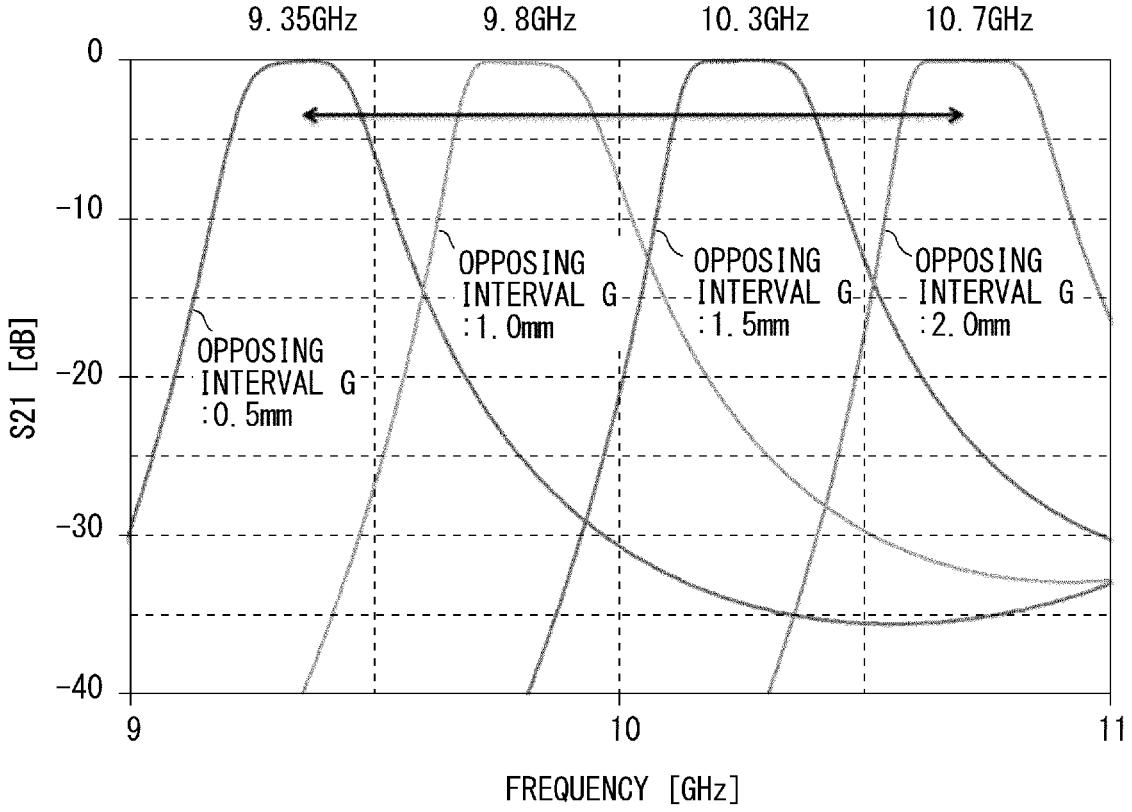
FIG. 13 is a diagram showing an exemplary center frequency of the passband of the band pass filter according to the second exemplary embodiment of the present invention.

FIG. 13 is a graph showing a S21 parameter in dB vs. an exemplary center frequency of the passband of the band pass filter in the case where the opposing interval G between the dielectric resonators 10*a*, 20*a*, the opposing interval G between the dielectric resonators 10*b*, 20*b*, and the opposing interval G between the dielectric resonators 10*c*, 20*c* are varied. Here, the conditions of the dielectric resonators 10, 20 are similar to those in FIG. 5. As shown in FIG. 13, the center frequencies (in GHz) of the passband of the band pass filter with an opposing interval G of 0.5 mm, an opposing interval G of 1.0 mm, an opposing interval G of 1.5 mm, and an opposing interval G of 2.0 mm are 9.35 GHz, 9.8 GHz, 10.3 GHz, 10.7 GHz, respectively. In this manner, as the opposing interval G becomes greater, the center frequency of the passband of the band pass filter becomes higher. It can be seen that, as the opposing interval G is varied from 0.5 mm to 2.0 mm, the center frequency largely varies from 9.35 GHz to 10.7 GHz.

As described above, in the present exemplary embodiment, three sets of two dielectric resonators 10, 20 are provided, and the opposing interval G in each of the three sets of dielectric resonators 10, 20 is variable. Here, when the opposing interval Gin each of the three sets of dielectric resonators 10, 20 is varied, the shape of the three sets of dielectric resonators 10, 20 as a whole varies and, consequently, a large variation of the resonance frequency is achieved. This configuration implements a band pass filter suitable for varying the center frequency of the passband.

Further, by virtue of dispensing with any additional component with low Q factor in the mechanism for varying the opposing interval G, this configuration also implements a band pass filter with a minimum degradation in Q factor. Further, with the band pass filter according to the present exemplary embodiment, Q factor changes little in the case where the opposing interval G is varied from 0 mm to 2.0 mm.

Further, in the present exemplary embodiment, the position in the top-bottom direction of the lower dielectric resonators 20 in the sets is fixed, and the upper dielectric resonators 10 in the sets are collectively shifted in the top-bottom direction, thereby collectively varying the opposing intervals G in the three sets of dielectric resonators 10, 20. Accordingly, as compared to the configuration in which the opposing intervals G in the three sets of dielectric resonators 10, 20 are varied individually on a set-by-set basis, a reduction in the number of the drive unit being a motor or the like, and a simplification of operations for adjusting the opposing intervals G are achieved.

In the foregoing, while a description has been given of the present invention based on the exemplary embodiments, the present invention is not limited thereby. The structure and details of the present invention can be modified in various manners that can be understood by a person skilled in the art within the scope of the invention.

For example, while the number of sets of two dielectric resonator is one in the first exemplary embodiment and three in the second exemplary embodiment, the number is not specified thereto and should be at least one.

Further, in the second exemplary embodiment, while several mechanisms that adjust the position in the top-bottom direction of the lower dielectric resonators in the sets have been shown, the position in the top-bottom direction of the lower dielectric resonators in the sets may be adjusted by the height (thickness) of the lower dielectric resonators in the sets.

Still further, in the second exemplary embodiment, first, the lower dielectric resonators in the sets are adjusted in the state where they are the lower dielectric resonators are physically disposed according to the design parameter, and thereafter the upper dielectric resonators in the sets are collectively shifted in the top-bottom direction, thereby varying the opposing interval G. Conversely, the following configuration is also possible: first, the upper dielectric resonators in the sets are collectively shifted in the top-bottom direction thereby varying the opposing interval G, and thereafter the lower dielectric resonators in the sets are adjusted to the state where the lower dielectric resonators are physically disposed according to the design parameter.

Still further, in the exemplary case shown in the second exemplary embodiment, as a result of adjusting the lower dielectric resonators in the sets to the state where the lower dielectric resonators are physically disposed according to the design parameter, the position in the top-bottom direction of the central dielectric resonator becomes higher than that of the dielectric resonators at the both ends. In this exemplary case, the opposing interval is different between the center and the both ends. The opposing interval G may be the one at the center or those at the both ends.

Still further, in the second exemplary embodiment, the position in the top-bottom direction of the lower dielectric resonators in the sets is fixed, and the upper dielectric resonators in the sets are collectively shifted in the top-bottom direction, thereby varying the opposing interval G. Conversely, the following configuration is also possible: the position in the top-bottom direction of the upper dielectric resonators in the sets is fixed, and thereafter the lower dielectric resonators in the sets are collectively shifted in the top-bottom direction, thereby varying the opposing interval G. In this configuration, a fixing member substantially similar to that in the second exemplary embodiment should be provided for the upper dielectric resonators in the sets, and a shifting mechanism substantially similar to that in the second exemplary embodiment should be provided for the lower dielectric resonators in the sets. Further, the following configuration is also possible: the upper dielectric resonators in the sets are collectively shifted in the top-bottom direction, and the lower dielectric resonators in the sets are collectively shifted in the top-bottom direction, thereby varying the opposing interval G. In this configuration, shifting mechanisms (the first and second shifting mechanisms) substantially similar to that in the second exemplary embodiment should be provided respectively for the upper dielectric resonators in the sets and the lower dielectric resonators in the sets. This configuration increases the adjustment range of the opposing interval G.

Still further, in the first and second exemplary embodiments, the shape of the two dielectric resonators are in an identical hollow circular cylindrical shape obtained by dividing a hollow circular cylinder into equal two parts along a section substantially parallel to the bottom surface. However, the present invention is not limited thereto. The shape of the two dielectric resonators is just required to be a shape obtained by dividing a cylinder (a right cylinder) into two parts along a section substantially parallel to the bottom surface, and just required to be capable of resonating in the TE01δ mode. The two dielectric resonators may be different in height in the top-bottom direction. Further, the two dielectric resonators each may or may not include a hollow part. Accordingly, the two dielectric resonators may each be in a circular cylindrical shape, a polygonal cylindrical shape (a quadrangular cylinder or an octagonal cylinder) or the like. On the other hand, as in the first and second exemplary embodiments, the dielectric resonators each having a hollow part achieve a reduction in weight of the dielectric resonators, contributing in reducing loads on the drive unit shifting the dielectric resonators in the top-bottom direction. Further, as shown in FIG. 5, such a structure sets the unwanted higher-order resonance frequencies farther from the resonance frequency of TE01δ mode. Therefore, each dielectric resonator is suitably in a shape having a hollow part. Further, as in the first and second exemplary embodiments, when the two dielectric resonators are in the shape obtained by dividing a cylinder into equal two parts (that is, when the two dielectric resonators are substantially identical to each other in height in the top-bottom direction), as shown in FIG. 13, a greater adjustment range of the center frequency of the passband of the band pass filter is provided (the adjustment range of the center frequency in FIG. 13 is 9.35 GHz to 10.7 GHz). Accordingly, suitably the two dielectric resonators are substantially identical to each other in height in the top-bottom direction.

Still further, in the first and second exemplary embodiments, the opposing interval G between the two dielectric resonators is as great as 2 mm. However, the present invention is not limited thereto. Since the opposing interval G depends on the size of the housing, and thus, cannot exceed the height of the housing, the opposing interval G should be set as appropriate according to the size of the housing.

Still further, in the first and second exemplary embodiments, the permittivity of the dielectric resonator is 29.8. However, the present invention is not limited thereto. Since the resonance frequency of the dielectric resonator depends not only on the shape but also on the permittivity, the permittivity should be set as appropriate according to a desired resonance frequency or the like.

Still further, in the first and second exemplary embodiments, the two dielectric resonators are disposed so as to oppose to each other in the top-bottom direction. However, the present invention is not limited thereto. The present invention is also applicable to the structure in which the dielectric resonators are disposed so as to oppose to each other in other direction, such as the horizontal direction.

In the following, the present invention is summarized. As has been described above, in the band pass filter of the present invention, the first and second dielectrics (for example, the above-described dielectric resonators 10, 20) are disposed so as to oppose to each other, and the opposing interval between the first and second dielectrics is adjusted by adjusting means (for example, the above-described interval adjusting mechanism), thereby varying the center frequency of the passband. In this manner, by varying the opposing interval between the first and second dielectrics, the shape of the first and second dielectrics as a whole varies and, consequently, a large variation of the resonance frequency is achieved. Thus, the band pass filter suitable for varying the center frequency of the passband is implemented.

Also, the whole or part of the example embodiments disclosed above can be described as, but not limited to, the following supplementary notes.

Supplementary Note 1

A band pass filter comprising:

first and second TE01δ-mode dielectric resonators disposed so as to oppose to each other; and a housing made of metal enclosing the first and second dielectric resonators, wherein an opposing interval between the first and second dielectric resonators is variable.

Supplementary Note 2

The band pass filter according to Supplementary Note 1, comprising a plurality of sets of the first and second dielectric resonators in a second direction being substantially perpendicular to a first direction in which the first and second dielectric resonators oppose to each other, wherein the plurality of sets of the first and second dielectric resonators are enclosed by the housing.

Supplementary Note 3

The band pass filter according to Supplementary Note 2, further comprising:

a fixing member for fixing a position in the first direction of the first dielectric resonators in the sets; and a shifting mechanism for collectively shifting the second dielectric resonators in the sets in the first direction.

Supplementary Note 4

The band pass filter according to Supplementary Note 3, wherein the fixing member includes a plurality of mounts installed at an inner surface of the housing, to which mounts the first dielectric resonators in the sets are fixed so as to have back surfaces thereof relative to opposing surfaces thereof being in contact with the mounts, respectively, the shifting mechanism includes a shifting plate disposed to extend in the second direction in an inner space of the housing, to which shifting plate the second dielectric resonators in the sets are fixed so as to have back surfaces thereof relative to opposing surfaces thereof being in contact with the shifting plate, and a drive unit shifting the shifting plate in the first direction.

Supplementary Note 5

The band pass filter according to Supplementary Note 4, further including a disposition adjusting mechanism for adjusting the first dielectric resonators in the sets to a state where the first dielectric resonators in the sets are physically disposed according to a design parameter used in designing the band pass filter.

Supplementary Note 6

The band pass filter according to Supplementary Note 5, wherein the disposition adjusting mechanism is a mechanism adjusting an electromagnetic field distribution of the first dielectric resonators in the sets.

Supplementary Note 7

The band pass filter according to Supplementary Note 5, wherein the disposition adjusting mechanism is a mechanism adjusting the position in the first direction of the first dielectric resonators in the sets.

Supplementary Note 8

The band pass filter according to Supplementary Note 2, further comprising:

a first shifting mechanism for collectively shifting the first dielectric resonators in the sets in the first direction; and a second shifting mechanism for collectively shifting the second dielectric resonators in the sets in the first direction.

Supplementary Note 9

The band pass filter according to Supplementary Note 8, wherein the first shifting mechanism includes a first shifting plate disposed to extend in the second direction in the inner space of the housing, to which first shifting plate the first dielectric resonators in the sets are fixed so as to have back surfaces thereof relative to opposing surfaces thereof being in contact with the first shifting plate, and a first drive unit shifting the first shifting plate in the first direction, wherein the second shifting mechanism includes a second shifting plate disposed in the second direction in the inner space of the housing, to which second shifting plate the second dielectric resonators in the sets are fixed so as to have back surfaces thereof relative to opposing surfaces thereof being in contact with the second shifting plate, and a second drive unit shifting the second shifting plate in the first direction.

Supplementary Note 10

The band pass filter according to any one of Supplementary Notes 1 to 9, wherein the first and second dielectric resonators have a shape obtained by dividing a cylinder into equal two parts along a cross section substantially parallel to a bottom surface of the cylinder, and the first and second dielectric resonators are disposed so as to oppose to each other in which resultant surfaces from the dividing being the opposing surfaces.

Supplementary Note 11

The band pass filter according to Supplementary Note 10, wherein the first and second dielectric resonators are substantially identical to each other in height in the first direction in which the first and second dielectric resonators oppose to each other.

Supplementary Note 12

The band pass filter according to Supplementary Note 10 or 11, wherein the first and second dielectric resonators each have a hollow part.

Supplementary Note 13

A method for controlling a band pass filter, comprising:

providing TE01δ-mode first and second dielectric resonators disposed so as to oppose to each other, and a housing made of metal enclosing the first and second dielectric resonators; and varying an opposing interval between the first and second dielectric resonators.

Supplementary Note 14

The method for controlling a band pass filter according to Supplementary Note 13, wherein a plurality of sets of the first and second dielectric resonators are provided in a second direction being substantially perpendicular to a first direction in which the first and second dielectric resonators oppose to each other, the plurality of sets of the first and second dielectric resonators are enclosed by the housing, and the opposing interval in each of the plurality of sets of the first and second dielectric resonators is varied.

Supplementary Note 15

The method for controlling a band pass filter according to Supplementary Note 14, further comprising:

fixing a position in the first direction of the first dielectric resonators in the sets; and varying the opposing interval in each of the plurality of sets of the first and second dielectric resonators by collectively shifting the second dielectric resonators in the sets in the first direction.

Supplementary Note 16

The method for controlling a band pass filter according to Supplementary Note 15, further comprising:

fixing, to a plurality of mounts installed at an inner surface of the housing, the first dielectric resonators in the sets so as to have back surfaces thereof relative to opposing surfaces thereof being in contact with the mounts;

fixing, to a shifting plate disposed to extend in the second direction in the inner space of the housing, the second dielectric resonators in the sets so as to have back surfaces thereof relative to opposing surfaces thereof being in contact with the shifting plate; and varying the opposing interval in each of the plurality of sets of the first and second dielectric resonators by shifting the shifting plate in the first direction by a drive unit.

Supplementary Note 17

The method for controlling a band pass filter according to Supplementary Note 16, further including, before or after varying the opposing interval in each of the plurality of sets of the first and second dielectric resonators, adjusting the first dielectric resonators in the sets to a state where the first dielectric resonators are disposed in a physical dimension according to a design parameter used in designing the band pass filter.

Supplementary Note 18

The method for controlling a band pass filter according to Supplementary Note 17, wherein, the first dielectric resonators in the sets are adjusted to the state where the first dielectric resonators in the sets are disposed in the physical dimension according to the design parameter by adjusting an electromagnetic field distribution of the first dielectric resonators in the sets.

Supplementary Note 19

The method for controlling a band pass filter according to Supplementary Note 17, wherein, the first dielectric resonators in the sets are adjusted to the state where the first dielectric resonators in the sets are arranged in the physical dimension according to the design parameter by adjusting a position in the first direction of the first dielectric resonators in the sets.

Supplementary Note 20

The method for controlling a band pass filter according to Supplementary Note 14, further comprising:

varying the opposing interval in each of the plurality of sets of the first and second dielectric resonators by collectively shifting the first dielectric resonators in the sets in the first direction, and collectively shifting the plurality of the sets of the second dielectric resonator in the first direction.

Supplementary Note 21

The method for controlling a band pass filter according to Supplementary Note 20, further including:

fixing, to a first shifting plate disposed to extend in the second direction in the inner space of the housing, the first dielectric resonators in the sets so as to have back surfaces thereof relative to opposing surfaces thereof being in contact with the first shifting plate;

fixing, to a second shifting plate disposed to extend in the second direction in the inner space of the housing, the second dielectric resonators in the sets so as to have back surfaces thereof relative to opposing surfaces thereof being in contact with the second shifting plate; and varying the opposing interval in each of the plurality of sets of the first and second dielectric resonators by shifting the first and second shifting plates in the first direction by a drive unit.

Supplementary Note 22

The method for controlling a band pass filter according to any one of Supplementary Notes 13 to 21, wherein the first and second dielectric resonators have a shape obtained by dividing a cylinder into equal two parts along a cross section substantially parallel to a bottom surface of the cylinder, and the first and second dielectric resonators are disposed so as to oppose to each other in which resultant surfaces from the dividing being the opposing surfaces.

Supplementary Note 23

The band pass filter according to Supplementary Note 22, wherein the first and second dielectric resonators are substantially identical to each other in height in the first direction in which the first and second dielectric resonators oppose to each other.

Supplementary Note 24

The method for controlling a band pass filter according to Supplementary Note 22 or 23, wherein the first and second dielectric resonators each have a hollow part.

Supplementary Note 25

A band pass filter comprising:

first and second dielectrics; and adjusting means for adjusting an opposing interval between the first and second dielectrics, wherein a center frequency of a passband is varied by the adjusting means.

REFERENCE SIGNS LIST

10 dielectric resonator
10*a*, 10*b*, 10*c* dielectric resonator
20 dielectric resonator
20*a*, 20*b*, 20*c* dielectric resonator
20 housing
30*a*, 30*b*, 30*c* housing
31*a* adjustment screw
32*a* nut
33*b*, 33*c* spot face
40 input/output port
50 input/output port
60 coupling window
70 coupling window
80*a*, 80*b*, 80*c* mount
90 shifting plate
100 supporting rod
110 supporting rod

The invention claimed is:

1. A band pass filter comprising:

first and second TE01δ-mode dielectric resonators disposed so as to oppose to each other; and a housing made of metal enclosing the first and second dielectric resonators, wherein an opposing interval between the first and second dielectric resonators is variable, wherein the band pass filter comprises a plurality of sets of the first and second dielectric resonators arranged in a second direction being substantially perpendicular to a first direction in which the first and second dielectric resonators are aligned to oppose to each other, wherein the first and second dielectric resonators comprise one of the plurality of sets of the first and second dielectric resonators, and wherein the plurality of sets of the first and second dielectric resonators are enclosed by the housing.

2. The band pass filter according to claim 1, further comprising:

a fixing member configured to fix position, in the first direction, of the first dielectric resonators in the sets; and a shifting mechanism configured to collectively shift the second dielectric resonators in the sets in the first direction.

3. The band pass filter according to claim 2, wherein each one of the first dielectric resonators and second dielectric resonators comprises a back surface and an opposing surface that is opposite to the back surface, wherein the fixing member includes a plurality of mounts installed at an inner surface of the housing, wherein the first dielectric resonators in the sets are fixed to the mounts so that the back surfaces of the first dielectric resonators are in contact with the mounts, and wherein the shifting mechanism includes:

a shifting plate disposed to extend in the second direction in an inner space of the housing, the second dielectric resonators in the sets being fixed to the shifting plate so that the back surfaces of the second dielectric resonators are in contact with the shifting plate; and a drive unit configured to shift the shifting plate in the first direction.

4. The band pass filter according to claim 3, further comprising a disposition adjusting mechanism configured to adjust the first dielectric resonators in the sets to a state where the first dielectric resonators in the sets are physically disposed according to a design parameter.

5. The band pass filter according to claim 1, wherein the first and second dielectric resonators have a shape obtained by dividing a cylinder into equal two parts along a cross section substantially parallel to a bottom surface of the cylinder so that each one of the first and second dielectric resonators comprises a divided surface that resulted from the dividing, and wherein the first and second dielectric resonators are disposed so as to oppose to each other so that the divided surfaces are opposing surfaces.

6. The band pass filter according to claim 5, wherein the first and second dielectric resonators are substantially identical to each other in height in the first direction in which the first and second dielectric resonators oppose to each other.

7. The band pass filter according to claim 5, wherein the first and second dielectric resonators each have a hollow part.

8. A method for controlling a band pass filter, the method comprising:

providing TE01δ-mode first and second dielectric resonators disposed so as to oppose to each other, and a housing made of metal enclosing the first and second dielectric resonators; and varying an opposing interval between the first and second dielectric resonators, wherein a plurality of sets of the first and second dielectric resonators are provided in a second direction being substantially perpendicular to a first direction in which the first and second dielectric resonators are aligned to oppose to each other, wherein the first and second dielectric resonators comprise one of the plurality of sets of the first and second dielectric resonators, wherein the plurality of sets of the first and second dielectric resonators are enclosed by the housing, and wherein the opposing interval in each of the plurality of sets of the first and second dielectric resonators is varied.

9. The method for controlling a band pass filter according to claim claim 8, the method further comprising:

fixing a position in the first direction of the first dielectric resonators in the sets; and varying the opposing interval in each of the plurality of sets of the first and second dielectric resonators by collectively shifting the second dielectric resonators in the sets in the first direction.

10. The method for controlling a band pass filter according to claim 9, wherein each one of the first dielectric resonators and second dielectric resonators comprises a back surface and an opposing surface that is opposite to the back surface, and wherein the method further comprises:

fixing, to a plurality of mounts installed at an inner surface of the housing, the first dielectric resonators in the sets so that the back surfaces of the first dielectric resonators are in contact with the plurality of mounts;

fixing, to a shifting plate disposed to extend in the second direction in the inner space of the housing, the second dielectric resonators in the sets so that the back surfaces of the second dielectric resonators are in contact with the shifting plate; and varying the opposing interval in each of the plurality of sets of the first and second dielectric resonators by shifting the shifting plate in the first direction by a drive unit.

* * * * *